US007988825B2

(12) United States Patent
Aula et al.

(10) Patent No.: US 7,988,825 B2
(45) Date of Patent: Aug. 2, 2011

(54) WEB-FORMING SECTION AND METHOD FOR MANUFACTURING MULTI-LAYER WEB

(75) Inventors: Jouko Aula, Muurame (FI); Peter Hardén, Poitsila (FI); Pekka Moilanen, Espoo (FI); Pasi Moilanen, legal representative, Espoo (FI)

(73) Assignee: Metso Paper, Inc., Helsinki (FI)

( * ) Notice: Subject to any disclaimer, the term of this patent is extended or adjusted under 35 U.S.C. 154(b) by 568 days.

(21) Appl. No.: 12/090,430

(22) PCT Filed: Oct. 25, 2006 (Under 37 CFR 1.47)

(86) PCT No.: PCT/FI2006/050459

§ 371 (c)(1), (2), (4) Date: Sep. 8, 2008

(87) PCT Pub. No.: WO2007/048877

PCT Pub. Date: May 3, 2007

(65) Prior Publication Data

US 2009/0165973 A1 Jul. 2, 2009

(30) Foreign Application Priority Data

Oct. 26, 2005 (FI) ..... 20055574

(51) Int. Cl.
*D21F 11/04* (2006.01)

(52) U.S. Cl. ..... 162/132; 162/304

(58) Field of Classification Search ..... 162/132, 162/133, 298, 299, 300, 303, 304
See application file for complete search history.

(56) References Cited

U.S. PATENT DOCUMENTS

| | | | |
|---|---|---|---|
| 3,438,854 | A | 4/1969 | Means |
| 4,425,187 | A | 1/1984 | Armstrong et al. |
| 4,447,295 | A | 5/1984 | Bubik et al. |
| 6,372,091 | B2 | 4/2002 | Wildfong et al. |

(Continued)

FOREIGN PATENT DOCUMENTS

| | | | |
|---|---|---|---|
| EP | 1225273 | A2 | 7/2002 |

(Continued)

OTHER PUBLICATIONS

Written Opinion of the International Searching Authority issued in PCT/FI2006/050459.

(Continued)

*Primary Examiner* — Eric Hug
(74) *Attorney, Agent, or Firm* — Stiennon & Stiennon

(57) ABSTRACT

A web-forming section of a paper or board machine has a first web-forming unit with a first fiber layer ($W_1$) formed on a first wire (10); a second web-forming unit with a second fiber layer ($W_2$) formed on a second wire (30); and a couch shoe (39) over a curved deck (40) of which the fiber layers ($W_1$, $W_2$) are guided for joining them together. The second fiber layer ($W_2$) is brought to the couch shoe (39) at an angle ($\alpha$) of less than 20°, advantageously less than 15° in relation to the approach direction of the first fiber layer ($W_1$). The couch shoe (39) is provided with underpressure and the radius of curvature of its deck (40) is usually larger than the radius of curvature of a guide roll (38) preceding it. By the couch shoe, the fiber layers can be joined together wetter than usual.

24 Claims, 2 Drawing Sheets

U.S. PATENT DOCUMENTS

| | | | |
|---|---|---|---|
| 6,592,715 | B2 | 7/2003 | Halmschlager et al. |
| 7,491,295 | B2 | 2/2009 | Poikolainen et al. |

FOREIGN PATENT DOCUMENTS

| | | | | |
|---|---|---|---|---|
| WO | 92/05310 | A1 | | 4/1992 |
| WO | WO 2005/078187 | | * | 8/2005 |
| WO | 2007/048877 | A2 | | 5/2007 |
| WO | 2007/048877 | A3 | | 5/2007 |

OTHER PUBLICATIONS

International Search Report issued in PCT/FI2006/050459.

* cited by examiner

WEB-FORMING SECTION AND METHOD FOR MANUFACTURING MULTI-LAYER WEB

CROSS REFERENCES TO RELATED APPLICATIONS

This application is a U.S. national stage application of International App. No. PCT/FI2006/050459, filed Oct. 25, 2006, the disclosure of which is incorporated by reference herein, and claims priority on Finnish App. No. 20055574, filed Oct. 26, 2005.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a web-forming section of a paper or board machine which section is intended for manufacturing a multi-layer web and which comprises a first web-forming unit in which a first fiber layer is formed on a first wire, a second web-forming unit in which a second fiber layer is formed on a second wire, and a couch shoe over a curved deck of which the fiber layers are guided for joining them together.

The invention also relates to a method for manufacturing a multi-layer paper or board web.

When manufacturing a multi-layer web, separately formed fiber layers are usually joined together by means of a couch roll which is typically a perforated roll. An upper wire carrying the second fiber layer is guided over a sector of the couch roll which touches the route of the first fiber layer on a lower wire. After the couch roll, the web is detached from the upper wire and led forward carried by the lower wire.

A critical characteristic of multi-layer boards is the interlaminar strength of layers. Splitting or delamination is a problem which occurs especially with board machines running liquid-packaging grades and multi-layer grades. The question is then of coming loose of the upper or lower surface of the middle layer of a finished product, which causes severe problems in the end use of the product.

An important factor from the viewpoint of interlaminar strength is the amount of fines in the boundary of the fiber layers being joined. When one or both fiber layers are manufactured by gap former technique, low fines content in the boundaries being joined together can cause problems. Two-sided dewatering is known to generate fines washout from the vicinity of web surfaces. It can be generalized that the drier the fiber layers are when being joined together, the less there are fines in the boundaries and the worse they are bound together.

For improving inter-binding of layers, sometimes starch has been sprayed on the surface of separately formed fiber layers before joining them together. This can, however, cause problems in process management and cleansing.

Disadvantages related to the use of a couch roll are a sharp pressure pulse created in the nip and shear forces that cause orientation in the web. Furthermore, the rotation of the roll creates an underpressure pulse to the exit side of the nip which pulse can damage the web and, in the worst case, make the newly joined fiber layers separate from each other.

When using a couch roll, the solids content of the fiber layers being joined together has to be in a limited range which usually is 8-12%. At a too high solids content, it is difficult to obtain adequate interlaminar strength. A too low solids content can cause splashings and faults in the joined web. The solids content of fiber layers can be affected by dewatering equipment of web-forming units and their parameters. If one wishes to increase the production of a board machine, the alternatives are to add more effective dewatering equipment to the forming section and/or to increase the length of the wire section. Many times the extension of the wire section is not possible or cost-effective because of lack of space. In practice, the increase of capacity in a Fourdrinier machine means optimizing dewatering equipment and/or extension of the wire section. If both have already been done, increasing production is difficult.

The fiber layer coming from the upper wire unit is usually kept on the surface of the couch roll solely by adhesion forces between the fiber layer and the wire. At high running speeds, there is a risk that the fiber layer is detached from the wire in consequence of centrifugal force. U.S. Pat. No. 6,592,715 discloses an arrangement in which the couch roll or a couch shoe replacing it has been provided with a suction zone which is followed by an overpressure zone. The function of the suction zone is to make the second fiber layer adhere on the curved surface of the couch roll or shoe. In the overpressure zone, air or steam is blown to the web for detaching it from the upper wire. The fiber layers converge at a relatively sharp angle on the curved surface of the couch roll or shoe. Then, a sharp pressure pulse is created in the joint area which can damage the web being formed. The overpressure zone prevailing at the point of the nip further sharpens the pressure pulse being created.

From U.S. Pat. No. 4,425,187 is known a method for manufacturing a multi-layer paper web in which method a first fiber layer is formed on a first wire, and a second fiber layer is formed on a second wire. The fiber layers are led over a curved cover of a couch shoe and, simultaneously, between the fiber layers is fed a new stock layer from the headbox, whereby the couch gap also functions as a forming gap. The new stock layer brings more moisture and fines between the first and the second fiber layer, which improves the interlaminar strength of the layers of the web. The method and the apparatus used in it are, however, complex. Furthermore, dewatering from a so-called middle layer being fed between the fiber layers is difficult, because it takes place through two already drained fiber layers.

The object of the invention is to solve problems related to prior art.

SUMMARY OF THE INVENTION

In the arrangement according to the invention, separately formed fiber layers are joined together by means of a couch shoe which is located so that the second fiber layer comes to the couch shoe at an angle of less than 20°, advantageously less than 15° in relation to the approach direction of the first fiber layer on the first wire.

When wires carrying fiber layers converge at a very flat angle, a pressure pulse develops more slowly than in a traditional roll nip. A flatly developing pressure pulse does not stop the propagation of fiber suspension to the inlet side of the nip, whereby it is possible to bring the fiber layers or at least one of them to the couch shoe at a lower solids content than usual. In an embodiment of the invention, both fiber layers brought to the couch shoe have a solids content of 4-10%. In a second embodiment of the invention, the first fiber layer brought to the couch shoe has a solids content of 0.5-7% and the second fiber layer has a solids content of 7-12%.

Advantageously, a guide roll leading the travel of the second wire is placed in front of the couch shoe in the vicinity of the route of the first wire so that the second wire can be transferred from the guide roll to the couch shoe at a desired flat angle in relation to the first wire. The guide roll and the couch shoe are close to each other and fastened to the same support arm for facilitating wire change.

The couch shoe comprises at least one low-pressure chamber and its deck is provided with openings via which suction can be led to fiber layers traveling over the deck. The suction affects advantageously for the whole travel which the second wire travels along the deck of the couch shoe at first on its own and finally together with the first wire. The amount of underpressure can be different in different areas of the shoe.

It is possible to design the openings of the deck of the shoe so that a pulsating effect is avoided. A dewatering pressure remaining substantially constant is achieved e.g. by means of openings which are individual holes or which are slots running askew over the cross-direction of the machine. By using non-pulsating dewatering in the joint area, it can be assured that the structure of the web is not damaged during the joining of fiber layers.

Alternatively, the surface of the deck can be designed so that pulsating dewatering is achieved. The pulsating dewatering is achieved e.g. by slots or grooves extending in the cross-direction of the machine. The pulsating dewatering improves the formation of the web and causes movement of fines in the web. The pulsating effect of grooves or slots can be intensified by connecting them to a source of underpressure.

The deck can also include both slots and holes. On the inlet side of the deck, there can be a slot which removes air flowing along with the wire which air can cause spots to the web as a result of a pressure pulse. By combining a pattern of slots and holes in a suitable way, the movement of fines can be intensified in the web.

Advantageously, the open area of the deck of the shoe is 40-60%.

The radius of curvature of the deck of the shoe is usually larger than the radius of curvature of the guide roll preceding it. The radius of curvature can be e.g. in the range of 500-8,000 mm, advantageously it is more than 800 mm. The deck can also consist of two or more zones with different radii of curvature. Then, it is possible that one of the zones is substantially flat, whereby wires travel over the planar zone without curving.

When using an arrangement according to the invention, the fiber layers can be joined together wetter than usual. By means of the new embodiment, it is thus possible to widen the running window of the couching stage so that the solids content of one or both fiber layers can be decreased. This enables increasing production while using existing dewatering equipment. Correspondingly, on new board or paper machines the wire section can be made shorter than before. From the change in the geometry of the joint area also follows that a pipe roll, which is less expensive than the drilled-type roll traditionally used as the couch roll, can be used as the guide roll preceding the couch shoe. Furthermore, the number of auxiliary devices usually required by the couch roll can be decreased.

When the fiber layers are joined together on the curved surface of a stationary couch shoe, a sharp pressure pulse related to the rotation of the couch roll is avoided. Simultaneously, underpressure caused by the rotation of the roll is eliminated on the exit side of the couch nip. The radius of curvature of the shoe can be larger than the radius of curvature of the roll and further the radius of curvature can be different in different parts of the shoe. When the fiber layers are joined wetter than before, they will adhere to each other more strongly and the couch nip will not orientate the web. The suction transfers fines along with water from the lower fiber layer to the joint area thus improving interlaminar strength. In addition, it has been noticed that the couch shoe evens up the irregularities occurring in the moisture content of fiber layers before joining them together. By means of the couch shoe provided with suction, the solids content of the web exiting the web-forming section can be increased. A part of the dewatering previously implemented in connection with forming separate fiber layers is transferred to the joining stage of the fiber layers and to the dewatering stage following it.

The invention will now be described with reference to the figures of the accompanying drawings, to the details of which the invention is, however, by no means intended to be narrowly restricted.

DESCRIPTION OF THE PREFERRED EMBODIMENTS

Figure 1:
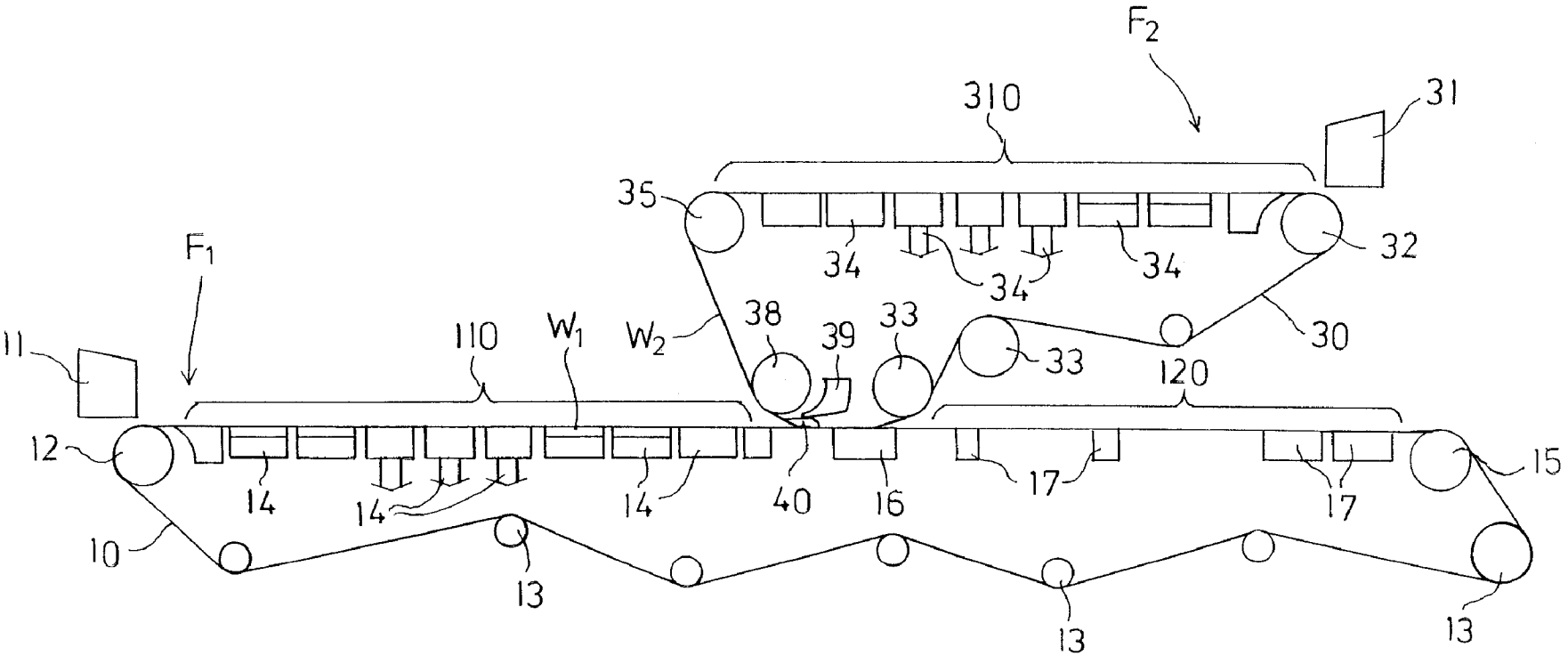
FIG. 1 is a schematic side view of a multi-layer web forming section provided with two web-forming units.

FIG. 1 schematically shows a web-forming section of a board machine producing a two-layer fiber web. It comprises a first web-forming unit $F_1$ on which a first fiber layer $W_1$ is formed, a second web-forming unit $F_2$ on which a second fiber layer $W_2$ is formed, and means for joining the separately formed fiber layers together.

The first web-forming unit $F_1$ comprises a first headbox 11 and a lower wire 10 which runs substantially horizontally from a breast roll 12 to a turning roll 15 from which it returns back guided by guide rolls 13. Stock suspension is fed from the headbox 11 over the breast roll 12 to the lower wire 10, in a first Fourdrinier wire section 110 of which water is removed from the stock suspension by means of dewatering elements 14 located below the wire 10 for forming the first fiber layer $W_1$. The dewatering elements 14 can be any dewatering elements commonly used on a Fourdrinier wire.

The horizontal portion of the lower wire 10 is divided into three parts which are the first Fourdrinier wire section 110, a twin-wire section in which an upper wire 30 travels together with the lower wire 10, and a second Fourdrinier wire section 120.

The second web-forming unit $F_2$ comprises a second headbox 31 and the upper wire 30 which travels substantially horizontally from a breast roll 32 to a turning roll 35, forming a Fourdrinier wire section 310 after which the wire 30 returns, guided by guide rolls 38, 33, back to the breast roll 32. Stock suspension is fed from the headbox 31 over the breast roll 32 to the upper wire 30, in the Fourdrinier wire section 310 of which water is removed from the stock suspension by means of dewatering elements 34 located below the wire 30 for forming the second fiber layer $W_2$.

Figure 2:
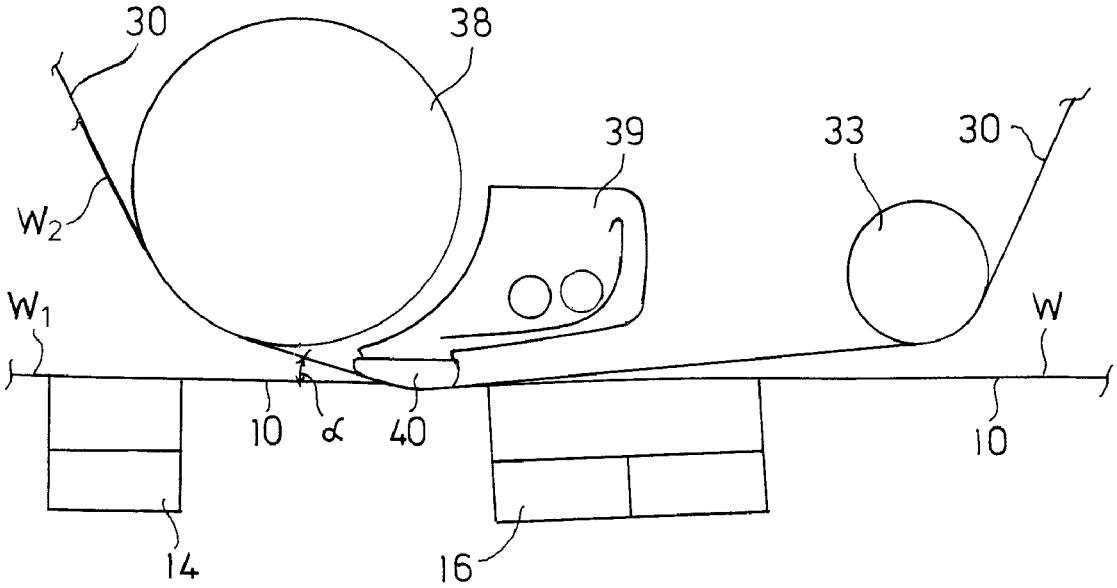
FIG. 2 shows enlarged a joint area in which separately formed fiber layers are joined together.

After the Fourdrinier wire section 310, the second fiber layer $W_2$ carried by the upper wire 30 is led by means of the turning roll 35 and the guide roll 38 towards the first fiber layer $W_1$ carried by the lower wire 10. The fiber layers $W_1$ and $W_2$ converge on a curved deck 40 of a couch shoe 39 on which they join together to a web W, as shown in FIG. 2. The upper wire 30 and the lower wire 10 constitute a short twin-wire zone which begins on the surface of the couch shoe 39 on the side of the upper wire 30 and ends on the surface of a pick-up suction box 16 on the side of the lower wire 10. After the pick-up suction box 16, the web W follows the lower wire 10 and the upper wire 30 is guided by means of the guide rolls 33 back to the breast roll 32.

The twin-wire zone is followed by the second Fourdrinier wire section 120 of the lower wire 10 in which water is removed from the web W by means of dewatering elements 17. After the Fourdrinier wire section 120, the web W is either transferred to a press section or, alternatively, new layers can be joined to it by means of the afore-described couching technique.

Figure 3:
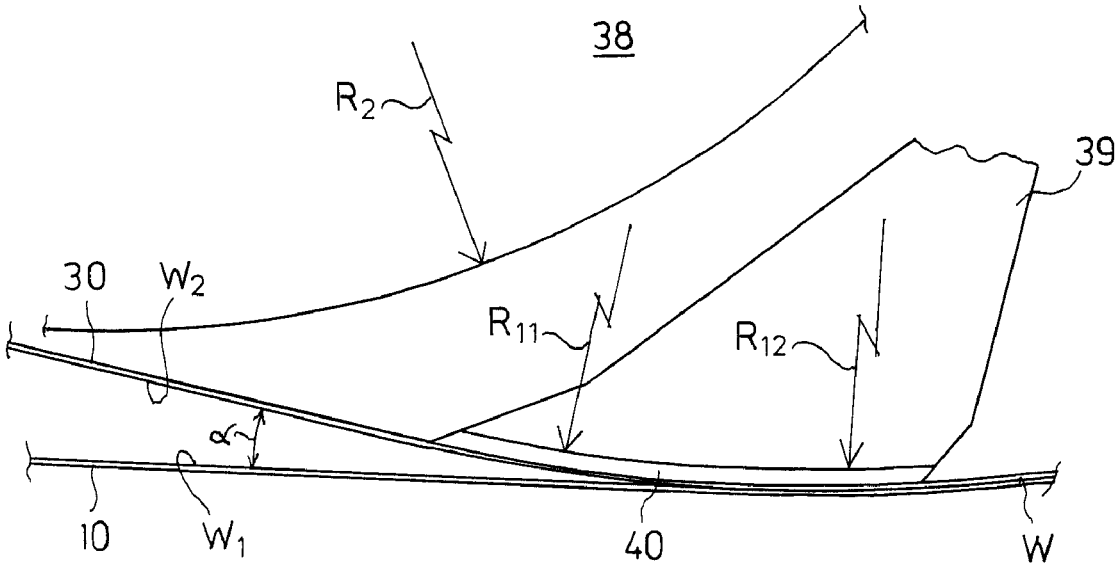
FIG. 3 is an enlarged view of the joint area of FIG. 2.

FIGS. 2 and 3 disclose in more detail joining means for joining the fiber layers $W_1$ and $W_2$ together. The upper wire 30 conveys the second fiber layer $W_2$ formed in the second web-forming unit $F_2$ over the guide roll 38 to the surface of the couch shoe 39. The lower wire 10 conveys the first fiber layer $W_1$ formed in the first web-forming unit $F_1$ past the couch shoe 39 so that the fiber layers $W_1$ and $W_2$ converge on the curved deck 40 of the shoe 39. The couch shoe 39 is located so that it presses the lower wire 10 somewhat downwards, whereby the tension of the wire 10 makes the fiber layers $W_1$ and $W_2$ couch together. Simultaneously, suction is applied to the fiber layers $W_1$ and $W_2$ via openings in the deck 40 of the shoe 39. The suction adheres the layers $W_1$, $W_2$ to the surface of the couch shoe 39, removes water from them and makes them bind more strongly to each other. As a result of the suction, fines move from the outer fiber layer $W_1$ to the boundary between the fiber layers $W_1$ and $W_2$ in which they contribute to the binding of the layers $W_1$ and $W_2$ to each other. An alternative is to arrange means known as such (not shown in the figure) before the nip by means of which means the first fiber layer $W_1$ is vibrated for improving the movement of fines before entering the bonding nip. Another alternative is to add an adhesive, such as starch, to the first fiber layer $W_1$ which adhesive in the bonding nip is transferred in consequence of underpressure to the boundary between the fiber layers.

After the couch shoe 39, the wires 10, 30 and the web W between them are guided over the pick-up suction box 16 on the side of the lower wire 10. Suction is applied to the web W through the lower wire 10 by the effect of which the web W is detached from the upper wire 30 and follows the lower wire 10. The pick-up suction box 16 can be parallel to the lower wire 10 or it can be a bit inclined against the lower wire 10. The deck of the pick-up suction box 16 can be flat or curved. The pick-up suction box 16 can comprise one or more underpressure zones in which different underpressures can prevail. Alternatively, the pick-up suction box can be replaced by a pick-up suction roll or a blower device arranged inside the upper wire.

FIG. 3 shows that the upper wire 30 brings the second fiber layer $W_2$ to the surface of the couch shoe 39 at a direction which constitutes an angle $\alpha$ with the approach direction of the lower wire 10, the extent of which angle is at the maximum 20°. Advantageously, the incidence angle $\alpha$ of the upper wire is at the maximum 15°. An incidence angle $\alpha$ of desired extent is provided with a suitable location of the guide roll 38 and the couch shoe 39 in relation to each other.

The couch shoe 39 is provided with a low-pressure chamber the suction produced by which pulls the fiber layers $W_1$, $W_2$ to the surface of the shoe 39 and removes water from them through the second wire 30. There can be one or more zones provided with underpressure in the shoe 39. The deck 40 is provided with dewatering openings which can be e.g. drilled holes, possibly joined to each other by grooves, or slots remaining between dewatering blades. It depends on the geometry of the deck 40 if the dewatering is non-pulsating or pulsating.

In FIG. 2, the deck 40 of the couch shoe 39 comprises two zones which have different radii of curvature $R_{11}$ and $R_{12}$. The radius of curvature $R_{11}$, $R_{12}$ is usually larger than the radius of curvature $R_2$ of the guide roll 38 preceding the shoe. Mostly, the radius of curvature of the shoe is in the range of 500-8,000 mm, advantageously more than 800 mm.

The example shows the forming of a multi-layer web using two Fourdrinier wire units. The method is also applicable for such arrangements in which one or both web-forming units are gap former units. The bonding strength of webs formed by the gap former technique is generally weaker than the one of webs formed by Fourdrinier wire and hybrid formers, because two-sided dewatering decreases the fines content on both surfaces of the web. By means of an arrangement according to the invention, the bonding strength of webs can be improved, whereby using gap formers in manufacturing multi-layer boards becomes more attractive. Naturally, the method is also applicable for arrangements in which there are more than two fiber layers to be joined.

Many different variations of the invention are possible within the scope defined by claims to be presented next.

The invention claimed is:

1. A web-forming section of a paper or board machine comprising:

a first web-forming unit arranged to form a first fiber layer on a first side of a first wire, the first wire arranged to travel in a first direction;

a second web-forming unit arranged to form a second fiber layer on a second wire;

a couch shoe having a curved deck spaced in the first direction from the first web-forming unit, the couch shoe arranged to guide the second fiber layer on the second wire into engagement with the first fiber layer on the first side of the first wire at an angle of less than 20° with respect to the first wire, wherein at the couch shoe the first fiber layer and the second fiber layer form a single joint web without an intermediate fiber layer therebetween;

wherein the couch shoe comprises at least one low-pressure chamber and the curved deck of the shoe is provided with openings in communication with the at least one low-pressure chamber such that suction is applied to the first and second fiber layers where the first wire and the second wire form a nip and wherein the shoe openings are located so that non-pulsating dewatering is provided.

2. The web-forming section of claim 1 wherein the curved deck is arranged to guide the second fiber layer on the second wire into engagement with the first fiber layer on the first wire at an angle of less than 15° with respect to the first wire.

3. The web-forming section of claim 1 further comprising a guide roll having a radius of curvature, the guide roll positioned to guide the second wire so that the second wire is transferred from the guide roll to the couch shoe at the angle of less than 20° with respect to the first wire.

4. The web-forming section of claim 1 wherein the curved deck openings are located so that non-pulsating dewatering is provided to the second fiber layer on the second wire along a travel path defined by where the second wire engages the curved deck of the couch shoe.

5. The web-forming section of claim 1 wherein the couch shoe comprises at least one low-pressure chamber and the deck of the shoe has a first part provided with openings which provide pulsating dewatering and the shoe has a second part provided with openings which provide non-pulsating dewatering.

6. The web-forming section of claim 3 wherein the deck of the shoe has a radius of curvature larger than the radius of curvature of the guide roll.

7. The web-forming section of claim 3 wherein the deck of the shoe has a radius of curvature which is more than 500 mm.

8. The web-forming section of claim 1 wherein the deck of the shoe comprises two or more zones having different radii of curvature.

9. The web-forming section of claim 1 wherein the deck of the shoe has an open area of 40-60%.

10. The web-forming section of claim 3 wherein the guide roll preceding the couch shoe is selected from the group consisting of: a smooth-surfaced roll, an open roll and a grooved roll.

11. The web-forming section of claim 1, wherein the second wire defines a closed loop defining an inside of the second wire, and wherein the couch shoe is located on the inside of the second wire loop and wherein a pick-up suction box is located spaced in the first direction from the couch shoe and on a second side of the first wire opposite the first side of the first wire, the pick-up suction box arranged for detaching the single joint web from the second wire.

12. The web-forming section of claim 11, wherein the pick-up suction box is inclined against the first direction of the first wire.

13. The web-forming section of claim 10, wherein the pick-up suction box has a curved deck.

14. The web-forming section of claim 1, wherein the first web-forming unit and the second web-forming unit are selected from the group consisting of: a Fourdrinier wire unit, a gap former and a hybrid former.

15. A method for manufacturing a multi-layer paper or board web comprising the steps of:

forming a first fiber layer on a first wire;

forming a second fiber layer on a second wire;

moving the first fiber layer on the first wire in a first direction which brings the first fiber web against a couch shoe;

moving the second fiber layer on the second wire in a second direction which brings the second wire into engagement with the couch shoe and the second fiber layer into engagement with the first fiber layer to form a couch nip at an angle of less than 20° between the first direction and the second direction; and guiding the first wire and the second wire running together over a curved deck of the couch shoe and joining the first fiber layer and the second fiber layer together with non-pulsating dewatering, while simultaneously applying suction through the curved deck of the couch shoe at the couch nip, to thus remove water from the first fiber layer and the second fiber layer and to cause the first fiber layer and the second fiber layer to bind to each other, without an intermediate fiber layer therebetween.

16. The method of claim 15 wherein the step of moving the second fiber layer on the second wire in the second direction which brings the second wire into engagement with the couch shoe is at an angle of less than 15° in relation to the first direction of the first fiber layer.

17. The method of claim 15, wherein the second fiber layer is brought to the couch shoe from a guide roll that guides the run of the second wire which is located so that the angle of less than 20° is provided between the first fiber layer and the second fiber layer as said layer approaches the couch shoe.

18. The method of claim 15 wherein suction is applied to the first fiber layer and the second fiber layer as they are being joined together via openings in the deck of the shoe.

19. The method of claim 15 wherein the first fiber layer and the second fiber layer are brought to the couch shoe with a solids content of 4-10%.

20. The method of claim 15 wherein the first fiber layer is brought to the couch shoe with a solids content of 0.5-7% and the second fiber layer is brought to the couch shoe with a solids content of 7-12%.

21. The method of claim 15 wherein, before guiding the first fiber layer and the second fiber layer to the couch shoe, the first fiber layer is vibrated for improving the movement of fines before bringing the second fiber layer into engagement with the first fiber layer, whereby a part of the fines is transferred by means of suction to the surface of the second fiber layer.

22. The method of claim 15 wherein, before the couch shoe, an adhesive is brought to the first fiber layer and, on the deck of the shoe, a part of the adhesive is transferred by means of suction to the surface of the second fiber layer.

23. The method of claim 22 wherein the adhesive is starch.

24. A method for manufacturing a multi-layer paper or board web comprising the steps of:

forming a first fiber layer on a first wire;

forming a second fiber layer on a second wire;

moving the first fiber layer on the first wire in a first direction which brings the first fiber web against a fixed couch shoe having a curved deck provided with suction;

moving the second fiber layer on the second wire in a second direction which brings the second fiber web on the curved deck of the couch shoe into direct engagement with the first fiber layer at an angle of less than 15° in relation to the first direction of the first fiber layer;

couching the first fiber layer and the second fiber layer together by locating the couch shoe so that it presses the first wire downwards so that tension in the first wire makes the first fiber layer and the second fiber layer couch together at a couch nip; and simultaneous with couching the first fiber layer and the second fiber layer together applying suction to the first fiber layer and the second fiber layer at the couch nip via openings in the curved deck of the shoe, the suction adhering the first fiber layer and the second fiber layer to each other and to the curved deck of the couch shoe, and by means of the suction moving fines from the first fiber layer to a boundary between the first fiber layer and the second fiber layer to contribute to the binding of the first fiber layer and the second fiber layer to each other.

* * * * *